US006031499A

United States Patent [19]

Dichter

[11] Patent Number: 6,031,499

[45] Date of Patent: Feb. 29, 2000

[54] MULTI-PURPOSE VEHICLE ANTENNA

[75] Inventor: Carl R. Dichter, Chandler, Ariz.

[73] Assignee: Intel Corporation, Santa Clara, Calif.

[21] Appl. No.: 09/083,751

[22] Filed: May 22, 1998

[51] Int. Cl.[7] ..... H01Q 1/32

[52] U.S. Cl. ..... 343/713; 343/725

[58] Field of Search ..... 343/713, 725, 343/705, 708, 715; H01Q 1/32, 21/00

[56] References Cited

U.S. PATENT DOCUMENTS

| | | | |
|---|---|---|---|
| 2,357,788 | 9/1944 | Yoder et al. | 343/872 |
| 4,030,100 | 6/1977 | Perrotti | 343/725 |
| 5,317,327 | 5/1994 | Piole | 343/725 |
| 5,528,248 | 6/1996 | Steiner et al. | 342/357 |
| 5,794,138 | 8/1998 | Briskman | 343/713 |

*Primary Examiner*—Michael C. Wimer
*Attorney, Agent, or Firm*—Trop, Pruner, Hu & Miles, P.C.

[57] ABSTRACT

An antenna for a motor vehicle provides both global positioning system and radio functionality. The antenna, which may be connected to a typical radio antenna body opening, may include a tubular portion which receives AM/FM radio signals and a planar member secured on top of the AM/FM radio antenna. The planar member may be for example, an active element for a global positioning system antenna and may be connected to a global positioning system receiver by wires that extend from the global positioning system antenna through the radio antenna to the global positioning system receive.

17 Claims, 2 Drawing Sheets

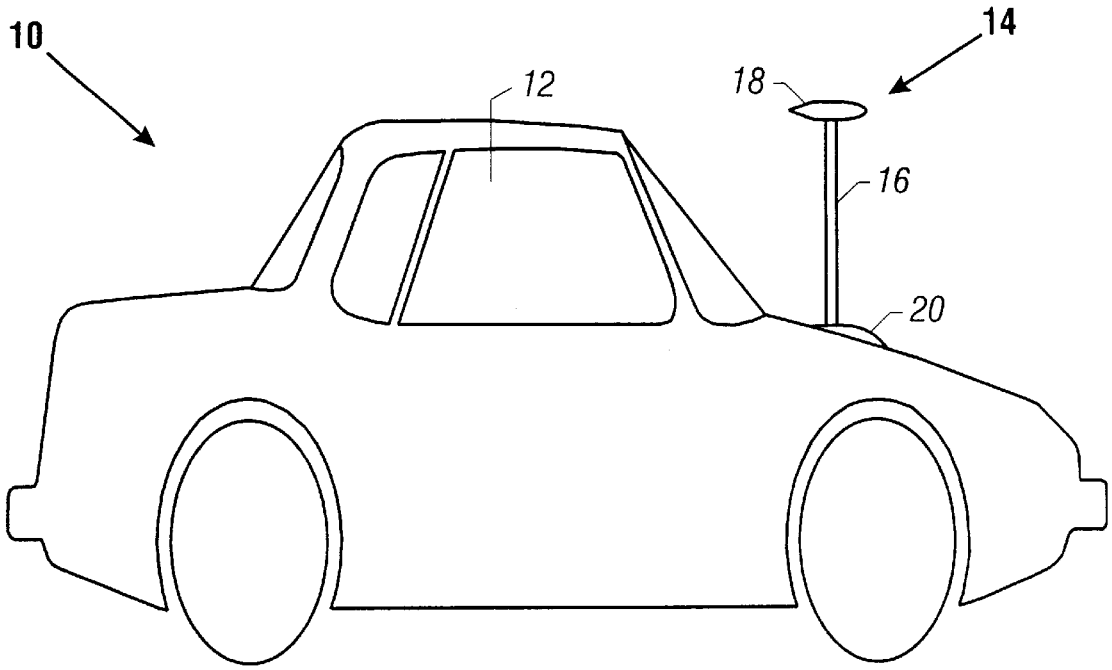
Figure 1
Figure 2
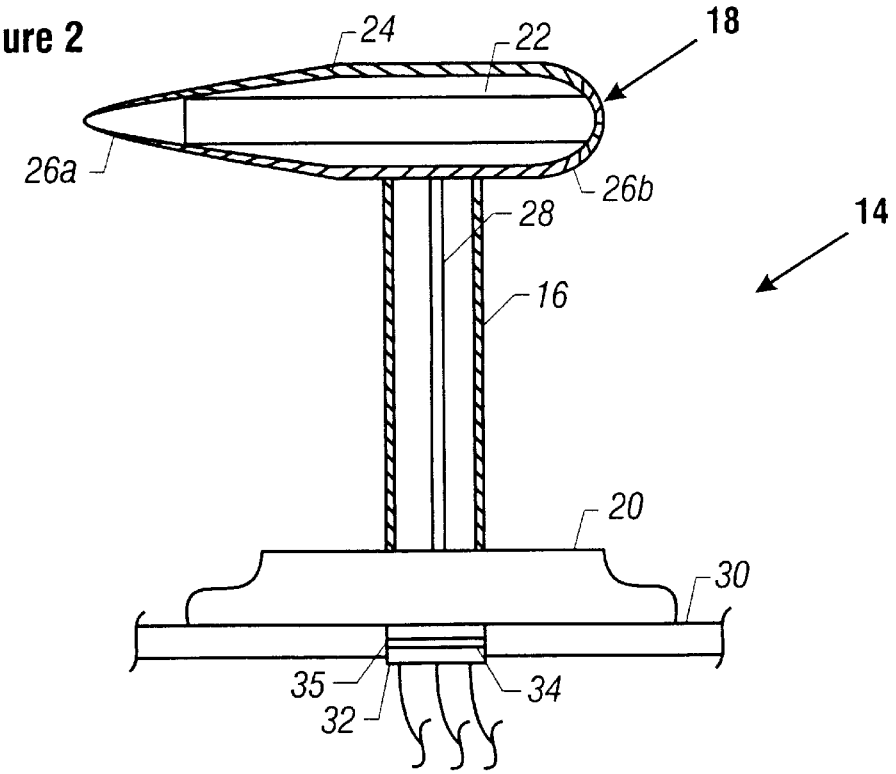

MULTI-PURPOSE VEHICLE ANTENNA

BACKGROUND

The invention relates generally to antennas for vehicles and particularly to the provision of global positioning system and radio functions in a vehicle.

There is an increasing interest in providing global position system (GPS) receivers in motor vehicles. With the GPS system, a driver may not only receive position information from the satellite positioning system, but he or she may also receive an indication on a map of his or her current position. Additional navigation functions may also be provided such that global positioning technology can provide the driver with a relatively advanced functionality at a very reasonable price.

There is also increasing interest in in-car personal computer systems. These systems may include a processor which may provide a number of traditional computer functions together with additional functions adapted to the motor vehicle, such as GPS or navigation functions. Thus, it is necessary to provide appropriate antennas for implementing these functions.

Today there are two common types of GPS antennas. With the active element, the antenna element is generally a flat planar structure and with active electronics. The passive structure is simpler to implement, but has some drawbacks with respect to quality. Since power must be supplied to active GPS antennas, the cabling is usually thicker.

One approach to providing GPS antennas in motor vehicles is simply to mount the antenna on top of the vehicle. However, this generally requires cutting a hole through the body of the vehicle for the passage of wires. This may be undesirable to many users who may not prefer to cut holes in their cars and the protruding antenna may interfere with the vehicle body lines creating a less desirable appearance.

It is also possible to cut a hole in the body of the vehicle, for example, at the trunk, add a mounting bracket and a GPS antenna below the hole. The hole then can be filled with an appropriate filler. Again, the vehicle body is permanently compromised. Moreover, the antenna does not have a full view of the sky and therefore, its operation may be adversely affected.

Still another approach is to put the GPS antenna in the center brake light enclosure or in the rear spoiler. However, this is only possible with car designs which are amenable to this configuration and again, they do not provide a full view of the sky.

Thus, there is a continuing need for an effective and desirable way to mount GPS antennas on motor vehicles.

SUMMARY

A vehicle antenna may include an AM/FM radio antenna in the form of an elongate, conductive tubular structure. A global positioning system antenna is mounted on the AM/FM radio antenna.

BRIEF DESCRIPTION OF THE DRAWINGS

FIG. 1 is a side elevational view of a vehicle equipped with a GPS antenna in accordance with one aspect of the present invention;

FIG. 2 is a partial, enlarged side elevational view of the antenna structure shown in FIG. 1.

DETAILED DESCRIPTION

Figure 3:
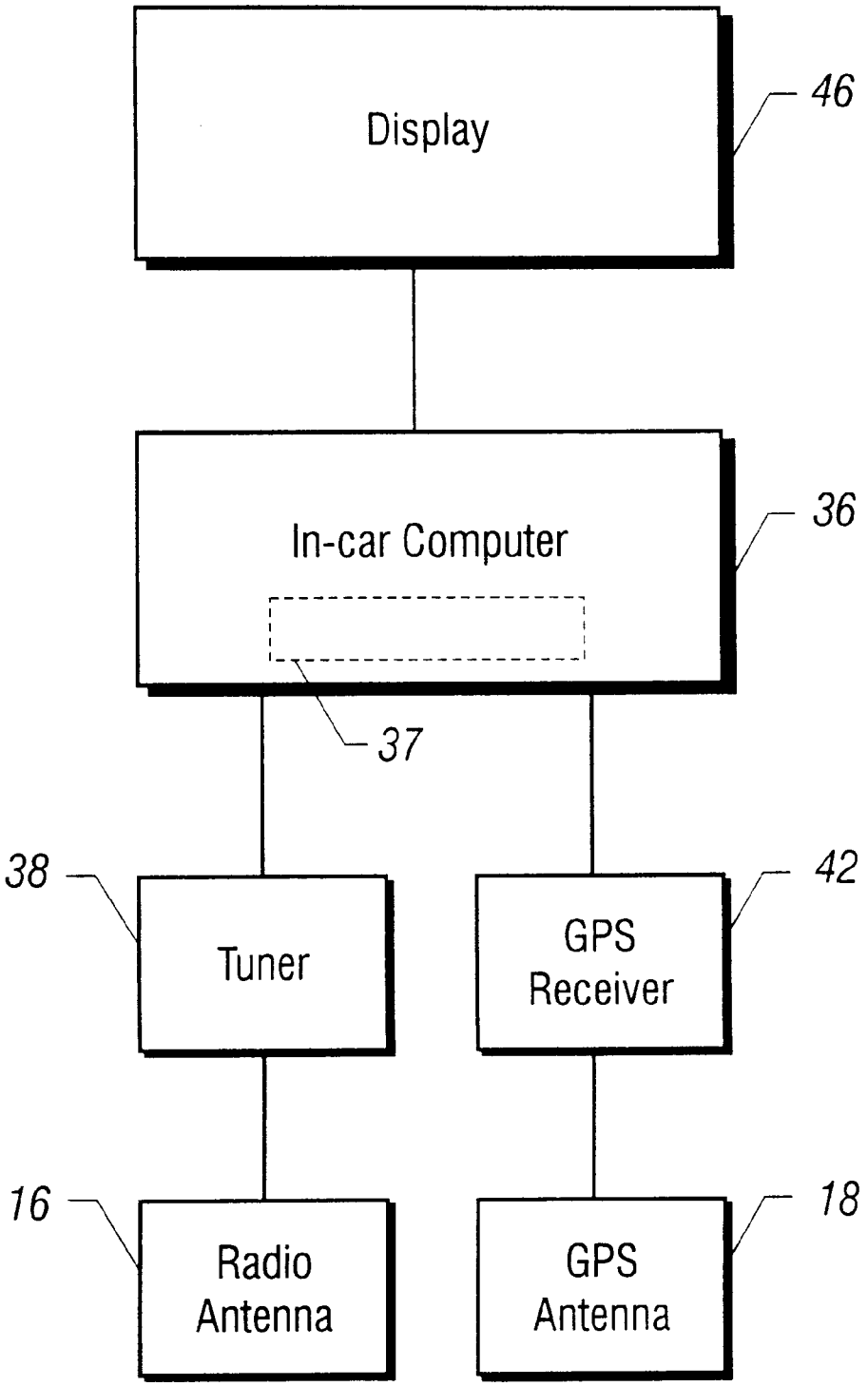
FIG. 3 is a block diagram of an in-car personal computer system.

Referring to FIG. 1, a motor vehicle 10, which may be, for example, a car or a truck, includes a passenger compartment 12. The passenger compartment 12 in the illustrated vehicle 10 is the highest vertically extending structure of the vehicle 10. A combined AM/FM radio and global positioning system (GPS) antenna 14 includes a GPS antenna 18 and an AM/FM radio antenna 16. As illustrated, the antenna 14 may mount like a conventional automotive antenna.

While the antenna 14 is illustrated as being a vertical antenna, the present invention can be implemented with angled antennas as well. It is generally desirable that the GPS antenna 18 be oriented such that it is generally parallel to the earth's surface. Thus, while the antenna 18 is illustrated as being generally transverse to the AM/FM radio antenna 16, if the antenna 16 were angled with respect to the earth's surface, the GPS antenna 18 would be angled at a non-transverse angle with respect to the AM/FM radio antenna 16.

The antenna 14 may be secured to the motor vehicle using a base 20. The base 20 may be a more substantial support than that which is conventionally utilized in connection with AM/FM radio antennas to provide the needed support for the GPS antenna 18.

Referring to FIG. 2, the GPS antenna 18 may include a GPS antenna element 22. The element 22 may be an active GPS antenna or it may be a passive antenna. Generally, active antennas are advantageous. The housing 24 may have a leading edge **26*b* and a trailing edge 26*a*. The housing 24 and particularly its leading and trailing edges 26, is designed to minimize the profile of the GPS antenna 18 and thereby to minimize the force applied by air to the GPS antenna 18**.

Thus in the illustrated embodiment, the housing 24 connects to the radio antenna 16 at a point closer to the leading edge **26*b* of the GPS antenna 18. With this configuration, the antenna 18 is generally self-leveling in the wind. For example, if the antenna tends to flex rearwardly, the wind forces on the trailing edge 26*a*** are increased, providing a force which tends to right the antenna back to its level configuration.

In general, the housing 24 provides an aerodynamically tapered configuration to maintain the antenna in a level configuration and to decrease its air resistance as the vehicle moves forwardly. Of course it is also possible to mount the antenna 22 in a more centered fashion with respect to the AM/FM radio antenna 16. Particularly with a low profile antenna 18, this may be advantageous.

The cabling 28 for the antenna element 22 extends through the generally elongate tubular AM/FM radio antenna 16. It also extends through the base 20 and connects to an appropriate GPS receiver (not shown). Likewise, an electrical connection is made to the antenna 16 which proceeds to the AM/FM radio tuner.

The base 20 may be enlarged to stabilize the antenna 14. It is desirable to decrease the oscillations of the antenna 14 to the greatest possible extent to improve the signal for GPS purposes. Thus, it may be desirable to stiffen the antenna 16 and to provide a relatively sturdy base 20. However, it is possible for the base 20 to fasten to the body panel 30 in a fashion conventionally utilized with automotive antennas. If necessary, the connection of the antenna to the vehicle can be stabilized, for example, by securing additional structures to reinforce the body panel 30 around the opening for the stub 32. In the illustrated embodiment, the stub 32 connected to the base 20 may be secured by threads 34 to the body panel 30. Other mounting arrangements may be utilized. It may be desirable in many circumstances, however, to use the existing antenna opening 35 to avoid additional hole cutting into the vehicle body.

Embodiments of the present invention may be advantageous among other reasons because they allow a GPS functionality to be provided without necessitating additional holes in the vehicle's body. Moreover, the GPS antenna may be positioned on top of the AM/FM radio antenna, above other signal blocking vehicle structures such as the passenger compartment 12, so as to provide a good receiver for GPS signals. In this way, the GPS antenna may have a very clear view of the entire sky for purposes of receiving GPS information.

Referring to FIG. 3, an in-car personal computer 36 may include a processor 37. The in-car personal computer system 36 may be mounted in the dashboard of the vehicle for example. The computer system 36 may include a display such as a flat screen display 46. The computer system 36 may also be coupled to a radio tuner 38 and a global positioning system receiver 42. The tuner 38 is in turn coupled to the radio antenna 16 while the GPS receiver 42 is coupled to the GPS antenna 18.

While the present invention has been described with respect to a limited number of embodiments, those skilled in the art will appreciate numerous modifications and variations therefrom. For example, if the antenna tends to oscillate, software may be utilized to filter out or average the oscillating GPS readings. Thus, the appended claims are intended to cover all such modifications and variations as fall within the true spirit and scope of the present invention.

What is claimed is:

1. A vehicle antenna for a vehicle having a vehicle body and a passenger compartment with a roof and having a radio receiver and a global positioning system accessible in said passenger compartment, said vehicle antenna comprising:

an elongate, conductive tubular AM/FM radio antenna to extend from said vehicle body at least to a level of said roof of said passenger compartment of said vehicle;

an electrical connector coupled to said AM/FM radio antenna to electrically couple said antenna to said radio receiver in said vehicle;

a global positioning system antenna mounted on the AM/FM radio antenna, a second electrical connector to electrically couple said global Positioning system antenna to said global positioning system within said vehicle, and a connector attached to a bottom end of said radio antenna to secure said antenna to said body of said vehicle.

2. The antenna of claim 1 including wires extending through the AM/FM radio antenna to the global positioning system antenna.

3. The antenna of claim 2 including an enlarged base extending outwardly from said radio antenna a sufficient distance to reduce oscillations in said antenna.

4. The antenna of claim 2 wherein the global positioning system antenna is positioned on top of the AM/FM radio antenna.

5. The antenna of claim 4 wherein the global positioning system antenna is generally planar and is oriented on the radio antenna such that the global positioning system antenna is substantially parallel to the earth's surface.

6. The antenna of claim 5 wherein the global positioning system antenna includes an active element.

7. The antenna of claim 1 including a vehicle having a passenger compartment, the antenna being attached to the vehicle such that the global positioning system antenna is located above the passenger compartment.

8. The antenna of claim 1 wherein the global positioning system antenna is aerodynamically tapered.

9. A computer system for a motor vehicle having a vehicle body and a passenger compartment with a roof and having a radio receiver and a global positioning system accessible in said passenger compartment, said computer system comprising:

a processor;

a global positioning system receiver coupled to the processor; and a global positioning system antenna including an elongate, conductive tubular AM/FM radio antenna connected at a lower end of said tubular antenna to said vehicle body of said motor vehicle and extending at least to a level of said roof of said passenger compartment of said vehicle; and a global positioning system element mounted on the AM/FM radio antenna at least at said level of said roof.

10. The system of claim 9 wherein the element is an active element, the active element being coupled to the global positioning system receiver by wires extending from the element to the receiver.

11. The system of claim 9 wherein the element is mounted on top of the radio antenna.

12. The computer system of claim 9 including an enlarged base extending outwardly from said radio antenna a sufficient distance to reduce oscillations in said antenna.

13. A motor vehicle comprising:

a vehicle body;

a passenger compartment with a roof and having a radio receiver and a global positioning system accessible in said passenger compartment; and an antenna secured to the body, the antenna including a tubular radio antenna secured at a lower end thereof to said body and extending from said body at least to a level of said roof of said passenger compartment of said vehicle; and a global positioning antenna secured on the radio antenna, said global positioning antenna being at least at said level of said roof.

14. The vehicle of claim 13 including an AM/FM radio coupled to the radio antenna and a global positioning system receiver coupled to the global positioning system antenna.

15. The motor vehicle of claim 14 including a personal computer coupled to said global positioning system receiver.

16. The motor vehicle of claim 13 wherein the global positioning system antenna is secured on the radio antenna and wires, connected to the global positioning system antenna, extend through the interior of the tubular radio antenna.

17. The motor vehicle of claim 13 including an enlarged base extending outwardly from said radio antenna a sufficient distance to reduce oscillations in said antenna.

* * * * *

UNITED STATES PATENT AND TRADEMARK OFFICE

CERTIFICATE OF CORRECTION

PATENT NO. : 6,031,499

DATED : February 29, 2000

INVENTOR(S) : CARL R. DICHTER

It is certified that error appears in the above-identified patent and that said Letters Patent is hereby corrected as shown below:

In col. 3, line 47, please replace "Positioning" with --positioning--.

Signed and Sealed this

Twelfth Day of December, 2000

*Attest:*

Q. TODD DICKINSON

*Attesting Officer*

*Director of Patents and Trademarks*